United States Patent [19]

Fujii et al.

[11] Patent Number: 4,796,574

[45] Date of Patent: Jan. 10, 1989

[54] SOHC TYPE INTERNAL COMBUSTION ENGINE

[75] Inventors: Noriaki Fujii; Takeshi Iwata; Toshihiro Oikawa, all of Wako, Japan

[73] Assignee: Honda Giken Kogyo Kabushiki Kaisha, Tokyo, Japan

[21] Appl. No.: 70,493

[22] Filed: Jul. 7, 1987

[30] Foreign Application Priority Data

Jul. 9, 1986 [JP] Japan ..... 61-161479

[51] Int. Cl.[4] ..... F01L 1/26

[52] U.S. Cl. ..... 123/90.23; 123/90.44

[58] Field of Search ..... 123/90.44, 90.27, 90.6, 123/193 H, 193 CH, 169 P, 169 PH, 90.23

[56] References Cited

U.S. PATENT DOCUMENTS

| | | | |
|---|---|---|---|
| 4,267,811 | 5/1981 | Springer | 123/90.27 |
| 4,553,515 | 11/1985 | King et al. | 123/90.27 |
| 4,612,885 | 9/1986 | Yoshikawa | 123/90.27 |
| 4,660,527 | 4/1987 | Tanaka et al. | 123/193 H |
| 4,660,529 | 4/1987 | Yoshikawa | 123/90.27 |
| 4,662,323 | 5/1987 | Moriya | 123/90.27 |
| 4,671,222 | 6/1987 | Gallot et al. | 123/90.27 |
| 4,741,302 | 5/1988 | Oda et al. | 123/90.23 |

FOREIGN PATENT DOCUMENTS

| | | | |
|---|---|---|---|
| 43228 | 3/1980 | Japan | 123/90.27 |
| 0674180 | 6/1952 | Switzerland | 123/90.23 |
| 2142975 | 1/1985 | United Kingdom . | |

*Primary Examiner*—Willis R. Wolfe
*Assistant Examiner*—M. Macy
*Attorney, Agent, or Firm*—Armstrong, Nikaido, Marmelstein & Kubovcik

[57] ABSTRACT

An SOHC type internal combustion engine wherein in a wall portion projectingly formed on a cylinder head and supporting a cam shaft is provided a bearing hole which supports a journal of the cam shaft having a larger diameter than the rotational path of the tip of a cam lobe, and an ignition plug insertion hole is provided continuous to an ignition plug mounting hole which is provided in the cylinder head and opens into the combustion chamber and wherein a protecting cylinder provided with the ignition plug insertion hole is integrally formed with the cam shaft receiving wall.

12 Claims, 3 Drawing Sheets

SOHC TYPE INTERNAL COMBUSTION ENGINE

BACKGROUND OF THE INVENTION

1. Field of the Invention

This invention relates to an SOHC internal combustion engine, and particularly to an improvement in an SOHC internal combustion engine in which a protecting cylinder having an ignition plug insertion hole is provided adjacent to an ignition plug mounting hole which opens in a center portion of the top surface of a combustion chamber of a cylinder head, and a cam shaft journal having a diameter larger than the path of the rotation of the tip of a cam nose is received in a bearing hole in a cam shaft receiving wall which is projectingly provided in the cylinder head.

2. Description of the Prior Art

Conventionally, an internal combustion engine in which a protecting cylinder is provided between a pair of cam shaft receiving walls is known. (Japanese Patent Kokai No. 125315/1979)

The rigidity of the cam shaft receiving wall and the protecting cylinder tends to be low because the cam shift receiving wall and the protecting cylinder project individually from the cylinder head.

SUMMARY OF THE INVENTION

An object of the present invention is to provide an internal combustion engine which can overcome the above problem.

The structure of the present invention is characterized in that the protecting cylinder and the cam shaft receiving wall are integrally formed.

With the arrangement as described above, the cam shaft receiving wall and the protecting cylinder reinforce each other and therefore, their rigidity is improved.

As a result of this improvement in rigidity, an ignition plug insertion hole in the protecting cylinder can be provided as close as possible to a bearing hole in the cam shaft receiving wall, and the thickness of the wall between the two holes can be made so thin that an ignition plug can easily be provided in the center portion of the top surface of the combustion chamber, without causing any problems relating to strength.

BRIEF DESCRIPTION OF THE DRAWINGS

Accompanying drawings illustrate one embodiment of the present invention, in which.

PREFERRED EMBODIMENT OF THE INVENTION

Figure 1:
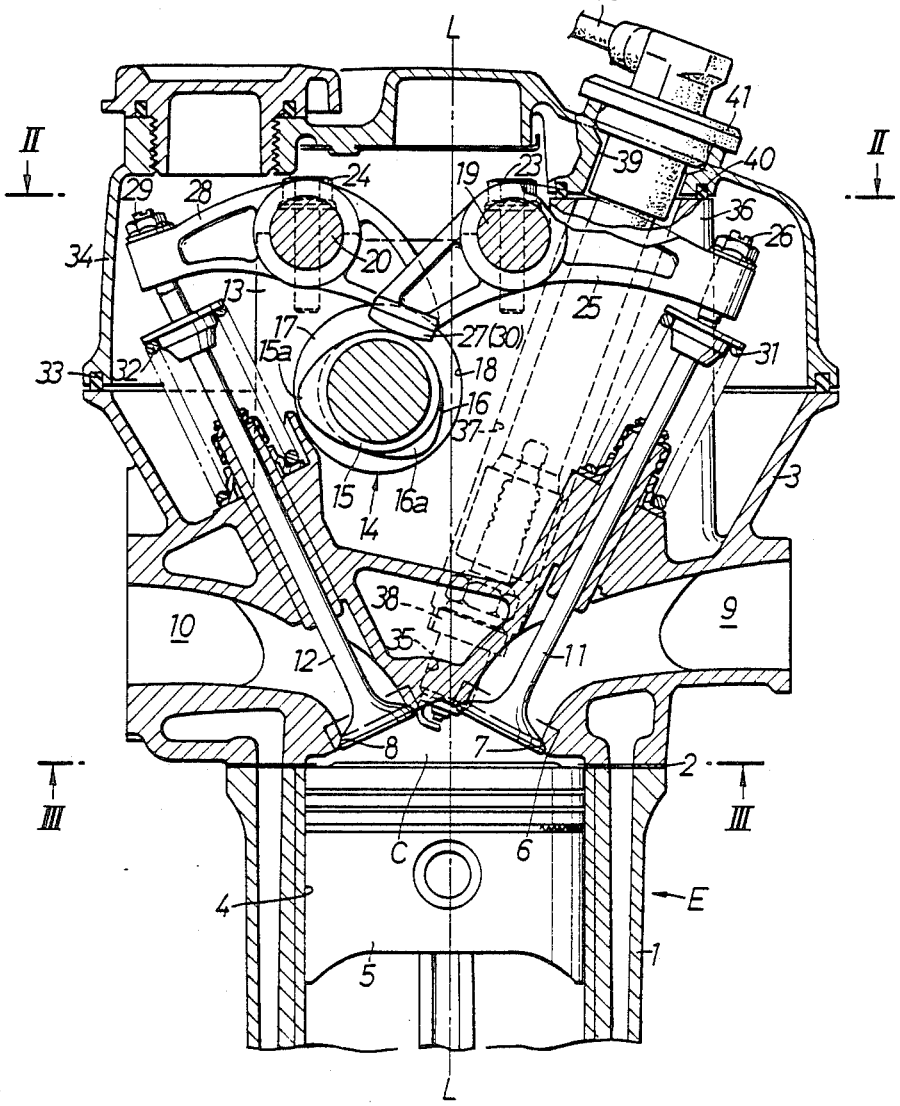
FIG. 1 is a vertical cross sectional front view.
Figure 2:
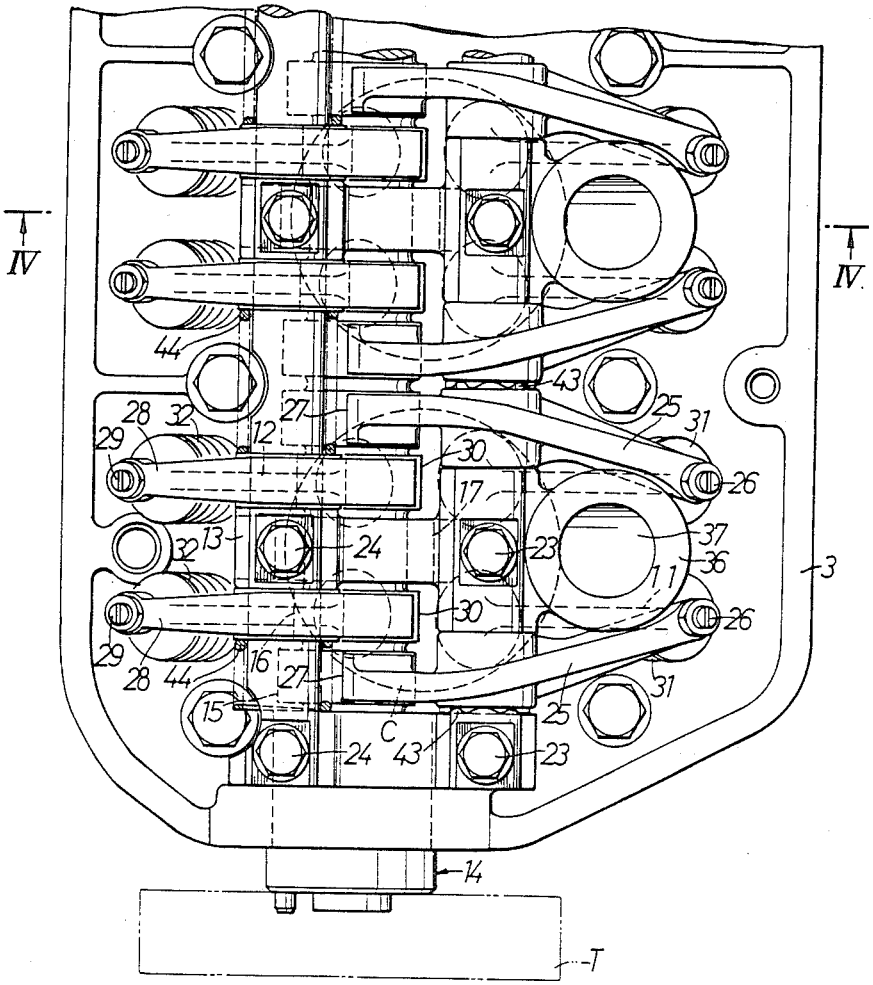
FIG. 2 is a cross sectional view taken along the line II—II in FIG. 1.
Figure 3:
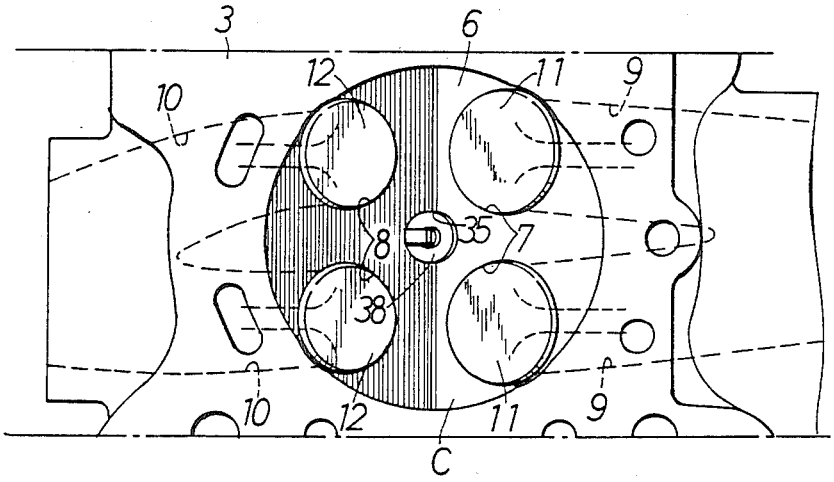
FIG. 3 is a view taken along the line III—III in FIG. 1.

Accompanying drawings illustrate an SOHC type four-valve multi-cylinder internal combustion engine in which an engine body E, shown in FIGS. 1 and 2, comprises a cylinder block 1 and a cylinder head 3 which is superposed and secured onto the cylinder block 1 with a gasket 2 therebetween. A piston 5 is slidably fitted into a cylinder bore 4 in the cylinder block 1. A combustion chamber C is formed in the cylinder head 3 in such a manner that the chamber faces a head surface of the piston 5. A top surface 6 of this combustion chamber is formed into a roof shape in which two surfaces re arranged facing each other at an angle. Two intake valve openings 7 of same diameter, as can clearly be seen in FIG. 3, open in parallel to one of the slanting surfaces of the top surface 6 of the combustion chamber. Two exhaust valve openings 8 having a diameter slightly smaller than that of the intake valve openings 7 open in parallel to the other slanting surface. The intake valve openings 7 face the exhaust valve openings 8.

Intake ports 9 formed in the cylinder head 3 are connected to the intake valve openings 7 and merge together within the cylinder head, and the combined part thereof opens in one side surface of the cylinder head 3, then is connected to a fuel supply device, such as a carburetor, through an intake manifold, omitted from the illustration. The exhaust valve opening 8 are connected to exhaust valve ports 10 which are formed in the cylinder head 3, and the exhaust valve ports 10 are merged together within the cylinder head 3, and the combined post thereof opens in the other side of the cylinder head 3, then is connected to an exhaust system through an exhaust manifold, omitted from the illustration.

A pair of intake valves 11 which act to open and close the intake valve openings 7 and a pair of exhaust valves 12 which act to open and close the exhaust valve openings 8 are slidably supported by the cylinder head 3. The intake valves 11 and the exhaust valves 12 are arranged at an angle on opposite sides of the center line L—L of the cylinder bore 4 in such a manner that their stem ends are far away from each other.

As can be seen from FIG. 2, each cam shaft receiving wall 13 is projectingly provided on the cylinder head 3 in the area between adjacent intake valves 11 or between adjacent exhaust valves 12. A cam shaft 14 is rotatably supported by the cam shaft receiving wall 13 and the side wall of the cylinder head, the position of the cam shaft being offset toward the exhaust valves 12 from the center line L—L of the cylinder bores 4. The cam shaft 14 has a plurality of intake cams 15, a plurality of exhaust cams 16, and a plurality of cam shaft journals 17 of a diameter which is larger than the path of the rotation of the tips of cam lobes 15*a* and 16*a* of the cams 15 and 16. Each cam shaft journal 17 is inserted into and received in a bearing hole 18 provided in each cam shaft receiving wall 13. The cam shaft 14 is, as in the conventional manner, arranged in operative connection with the crank shaft so as to be driven and rotated via a timing transmission device T.

Figure 4:
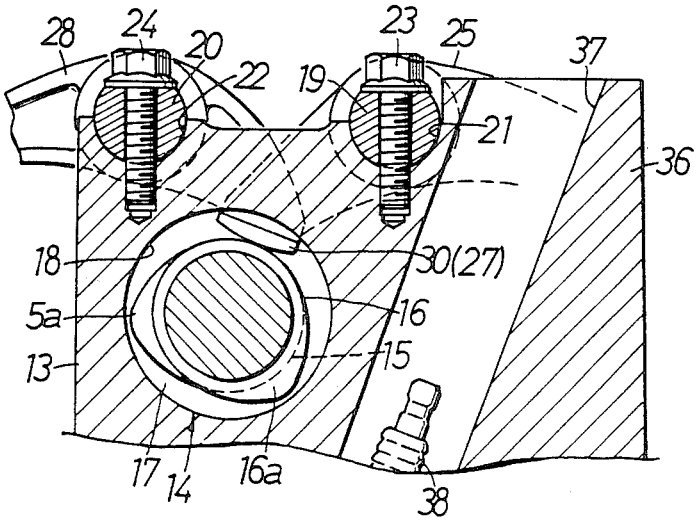
FIG. 4 is a cross sectional view taken along the line IV—IV in FIG. 2.

An intake rocker arm shaft 19 is provided between the intake valves 11 and the cam shaft 14, and an exhaust rocker arm shaft 20 is provided between the exhaust valves 12 and the cam shaft 14, the rocker arm shafts being in parallel to the cam shaft 14. As is shown in FIG. 4, the rocker arm shafts 19 and 20 ar respectively fitted into semicircular bearing recesses 21 and 22 which are formed in the top surface of the cam shaft receiving wall 13, and are fastened to the cam shaft receiving wall 13 by means of bolts 23 and 24. Two intake rocker arms 25 per cylinder are swingably supported on the intake rocker arm shaft 19. The outer ends of the rocker arms 25 abut against the end surfaces of the stems of the intake valves 11 through adjusters 26. Slipper portions 27 at the inner ends of the rocker arms 25 abut against the intake cams 15 of the cam shaft 14.

Two exhaust rocker arms 28 per cylinder are swingably supported on the exhaust rocker arm shaft 20. The outer ends of these rocker arms 28 abut against the end surfaces of the stems of the exhaust valves 12 through adjusters 29, and slipper portions 30 at the internal ends of the rocker arms abut against the exhaust cams 16 on the cam shaft 14. As shown in FIG. 2, wave washers 43 are provided for the intake rocker arm shaft 19, the washers being interposed between the side wall of the cylinder head 3 and the nearest rocker arm 25, and between adjacent rocker arms 25,for the purpose of forcing each rocker arm 25 toward the cam shaft receiving wall 13 and preventing each rocker arm 25 from moving in the axial direction. Compression springs 44 are provided for the exhaust rocker arm shaft 20, the springs being interposed between the side wall of the cylinder head and the nearest rocker arm 28, and between adjacent rocker arms 28, for the purpose of forcing each rocker arm 28 toward the cam shaft receiving wall 13 and preventing each rocker arm 28 from moving in the axial direction.

The intake rocker arms 25 and the exhaust rocker arms 28 are swung around the rocker arm shafts 19 and 20, respectively, and are adapted to open and close the corresponding intake valves 11 and exhaust valves 12 in cooperation with valve springs 31 and 32 as the cam shaft 14 rotates.

A head cover 34 is mounted over the opening in the cylinder head 3 with a sealing packing 33 therebetween.

An ignition plug mounting hole 35 opens in a center portion of the top surface 6 of each combustion chamber of the cylinder head 3, and a protecting cylinder 36, having an ignition plug insertion hole 37 which is communicated to the ignition plug mounting hole 35, is formed integrally with the cam shaft receiving wall 13 at a position offset toward the intake valves 11 from the center line L—L of the cylinder bore 4.

Since the cam shaft receiving wall 13 and the protecting cylinder 36 are integrally formed, they reinforce each other, so their rigidity is improved. As a result of this improvement in rigidity, the ignition plug insertion hole 37 in the protecting cylinder 36 and the bearing hole 18 in the cam shaft receiving wall 13 can be positioned as close together as possible, and the thickness between the holes 18 and 37 can be made thin without causing any problems concerning strength. Therefore, an ignition plug 38 can be easily provided in the center portion of the top surface 6 of the combustion chamber. The offset location of the cam shaft 14 is also important in this respect. The distance of flame propagation from the spark point to the peripheral edges of the combustion chamber C can be designed to be substantially equal and the time required for the combustion can be minimized, so that a high power output can be achieved by the provision of the ignition plug 38 as described above.

Further, the size of the internal combustion engine can be reduced because the cam shaft 14, rocker arm shafts 19 and 20, and the protecting cylinder 36 are compactly arranged because the cam shaft receiving wall 13 and the supporting cylinder 36 are formed integrally and the rocker arm shafts 19 and 20 are supported by the cam shaft receiving wall 13.

The end surface of the opening of the protecting cylinder 36 is communicated to an insertion hole 39 in the head cover 34, and a sealing ring 40 is interposed between the end surface of the opening and the internal end of the insertion hole 39. Since a joint portion provided between the head cover 34 and the protecting cylinder 36 is arranged near the head cover 34, this joint portion is positioned in the area where the amount of lubricating oil splashed up is small, and therefore, the sealing structure for the supporting cylinder 36 can be made simple, so that the sealing ring 40 is sufficient to seal the joint.

The outer end of a plug cap 41 fitted onto the ignition plug 38 is press-fitted into the insertion hole 39, and a high power cord 42 extending from the plug cap 41 is connected to an ignition system which is not shown.

What is claimed is:

1. An SOHC type internal combustion engine comprising a cylinder head which has a combustion chamber defined therein, a camshaft carried thereon, an ignition plug mounting hole opening to a center portion of a top surface of the combustion chamber and a protecting cylinder formed therein with an ignition plug insertion hole, wherein a journal for the camshaft has a diameter larger than a path of rotation of a lobe of a cam on the camshaft and is supported by a bearing hole formed in a camshaft receiving wall which is provided on said cylinder head, and said protecting cylinder and said camshaft receiving wall are formed in a single piece.

2. The engine of claim wherein said camshaft receiving wall extends in a plane generally perpendicular to the camshaft axis, and said protecting cylinder generally lies in said plane.

3. The engine of claim 1, wherein said ignition plug insertion hole is continuous with said ignition plug mounting hole.

4. The engine of claim 1, wherein said cylinder head is formed in one piece with said camshaft receiving wall and said protecting cylinder.

5. The engine of one of claims 1 or 2, wherein said camshaft is located on one side of an axis of a cylinder of the engine and said protecting cylinder is inclined toward an opposite side from said camshaft with respect to the axis of the cylinder.

6. The engine of claim 5, wherein said camshaft receiving wall extends across said camshaft at a point substantially corresponding to the center of said combustion chamber.

7. An SOHC type internal combustion engine, comprising:

a cylinder head having a combustion chamber defined therein;

a camshaft supported on said cylinder head;

a camshaft receiving wall provided on said cylinder head and extending laterally across said camshaft, said camshaft receiving wall having a bearing hole formed therein for supporting a camshaft journal of said camshaft where said camshaft journal has a diameter larger than a path of rotation of a lobe of a cam of said camshaft;

an ignition plug mounting hole opening to a center portion of a top surface of said combustion chamber; and a protection cylinder generally laterally aligned with said camshaft receiving wall and formed in a single piece therewith in order to present an ignition plug insertion hole within said protection cylinder.

8. The engine of claim 7, wherein said camshaft receiving wall extends in a plane generally perpendicular to the camshaft axis, and said protecting cylinder generally lies in said plane.

9. The engine of claim 7, wherein said ignition plug insertion hole is continuous with said ignition plug mounting hole.

10. The engine of claim 7, wherein said cylinder head is formed in one piece with said camshaft receiving wall and said protecting cylinder.

11. The engine of one of claims 7 or 8, wherein said camshaft is located on one side of an axis of a cylinder of the engine and said protecting cylinder is inclined toward an opposite side from said camshaft with respect to the axis of the cylinder.

12. The engine of claim 11, wherein said camshaft receiving wall extends across said camshaft at a point substantially corresponding to the center of said combustion chamber.

* * * * *